US008705754B2

(12) United States Patent
Yamkovoy et al.

(10) Patent No.: US 8,705,754 B2
(45) Date of Patent: Apr. 22, 2014

(54) MEASURING TRANSDUCER DISPLACEMENT

(75) Inventors: Paul G. Yamkovoy, Acton, MA (US); Pericles Nicholas Bakalos, Maynard, MA (US); Ricardo F. Carreras, Southborough, MA (US); Daniel M. Gauger, Jr., Cambridge, MA (US)

(73) Assignee: Bose Corporation, Framingham, MA (US)

( * ) Notice: Subject to any disclaimer, the term of this patent is extended or adjusted under 35 U.S.C. 154(b) by 376 days.

(21) Appl. No.: 13/075,899

(22) Filed: Mar. 30, 2011

(65) Prior Publication Data

US 2012/0249125 A1 Oct. 4, 2012

(51) Int. Cl.
*H04R 29/00* (2006.01)
*H04R 3/00* (2006.01)

(52) U.S. Cl.
USPC ..... 381/58; 381/111

(58) Field of Classification Search
USPC ..... 381/111, 117, 56, 58, 59, 102, 189
See application file for complete search history.

(56) References Cited

U.S. PATENT DOCUMENTS

| | | | | |
|---|---|---|---|---|
| 5,197,104 | A | 3/1993 | Padi | |
| 5,327,504 | A | 7/1994 | Hobelsberger | |
| 7,501,834 | B2 | 3/2009 | Madni et al. | |
| 8,180,066 | B2 * | 5/2012 | Thiele et al. | 381/86 |
| 2003/0048911 | A1 | 3/2003 | Furst et al. | |
| 2004/0184623 | A1 | 9/2004 | Johannsen et al. | |
| 2005/0031139 | A1 * | 2/2005 | Browning et al. | 381/96 |
| 2006/0285704 | A1 | 12/2006 | Kitazawa et al. | |
| 2010/0329495 | A1 | 12/2010 | Wendell et al. | |

FOREIGN PATENT DOCUMENTS

| | | | |
|---|---|---|---|
| EP | 1 737 120 | A1 | 12/2006 |
| JP | 55092097 | A | 7/1980 |
| JP | 06-205493 | A | 7/1994 |
| JP | 2007 020154 | A | 1/2007 |
| JP | 2008113108 | A | 5/2008 |
| JP | 2010 124026 | A | 6/2010 |
| WO | 2004/082330 | A1 | 9/2004 |

OTHER PUBLICATIONS

Carrier Signal, Wikipedia.*
Electronic Oscillator , Wikipedia.*
Frequency Modulation, Integrated website.*
Phased Lock Loop, Wikipedia.*
Demodulation, wikipedia.*
International Search Report and Written Opinion dated Apr. 18, 2012 for PCT/US2012/020400.
International Search Report and Written Opinion dated Jun. 6, 2012 for PCT/US2012/030684.
Catrysse, J.A.M., On the Design of Some Feedback Circuits for Loudspeakers, Katholike Industriele Hogeschool, B-8400 Oostende, Belgium, J. Audio Eng. Soc., vol. 33, No. 6, Jun. 1985, 6 pages.
Lane, Steve A. and Clark, Improving Loudspeaker Performance for Active Nosie Control Applications, Department of Mechanical Engineering and Materials Duke University, Durham, NC 277708-0302, USA, J. Audio Eng. Soc., vol. 46, No. 6, 1998 Jun. 1998, 12 pages.

* cited by examiner

*Primary Examiner* — Vivian Chin
*Assistant Examiner* — Ammar Hamid

(57) ABSTRACT

Displacement of a moving diaphragm in an electroacoustic transducer is measured by modulating an electrical signal based on changes in capacitance between the voice coil assembly and the magnetic structure resulting from relative motion between the voice coil and the magnetic structure. The modulated electrical signal is demodulated to produce an output signal having a value proportional to the displacement.

26 Claims, 8 Drawing Sheets

MEASURING TRANSDUCER DISPLACEMENT

BACKGROUND

This disclosure relates to measuring displacement of an electromechanical transducer.

Measuring the displacement of an electromechanical transducer permits feedback control systems to react to the position of the electromechanical transducer. Displacement measurements can be used to derive other values such as velocity, acceleration, and jerk. One or more of these measurements can be directly or indirectly used by a feedback control system for system control.

SUMMARY

In general, in some aspects, displacement of a moving diaphragm in an electroacoustic transducer having a magnetic structure and a voice coil assembly comprising at least a voice coil aligned with the magnetic structure, one of the magnetic structure or the voice coil assembly coupled to the diaphragm, is measured by modulating an electrical signal based on changes in capacitance between the voice coil and the cup resulting from motion of the voice coil relative to the cup to produce a modulated electrical signal, and demodulating the modulated electrical signal to produce an output signal having a value proportional to the displacement.

Implementations may include one or more of the following. Producing the modulated electrical signal may include applying a carrier signal having a frequency above an operating range of the electroacoustic transducer to a first input terminal of the voice coil, with the change in capacitance between the voice coil assembly and the magnetic structure of the transducer, resulting from motion of the voice coil assembly relative to the cup, modulating the amplitude of the carrier signal. Demodulating the modulated electrical signal may include amplitude-demodulating the modulated electrical signal to produce the output signal. Amplitude-demodulating the modulated electrical signal may include applying a high-pass filter to the modulated electrical signal to produce a high-pass filtered signal, applying a gain to the high-pass filtered signal to produce a level-adjusted signal, rectifying the level-adjusted signal to produce a rectified signal, and applying a low-pass filter to the rectified signal to produce the output signal. Amplitude-demodulating the modulated electrical signal may include providing the modulated electrical signal to a digital signal processor configured to perform amplitude demodulation. The carrier signal may be prevented from propagating to an audio signal input path of the transducer. This prevention may be by coupling the first input terminal of the voice coil to a first terminal of a first coil of an RF choke transformer, coupling a second input terminal of the voice coil to a first terminal of a second coil of the RF choke transformer, coupling a second terminal of the first coil to ground through a first capacitor and to a first signal input, and coupling a second terminal of the second coil to ground through a second capacitor and to a second signal input.

Producing the modulated electrical signal may include coupling the transducer to an oscillator circuit, with the change in capacitance between the voice coil and cup of the transducer, resulting from motion of the voice coil relative to the cup, modulating the frequency of the oscillator circuit. Demodulating the modulated electrical signal may include frequency-demodulating the modulated electrical signal to produce the output signal. Coupling the transducer to the oscillator may include electrically coupling the transducer to an op-amp, and configuring the op-amp for positive feedback operation, with the output of the op-amp producing the modulated electrical signal. Coupling the transducer to the op-amp may include electrically coupling the first input terminal of the voice coil and the cup of the transducer to respective first and second terminals of the primary coil of an RF transformer, and coupling a terminal of the secondary coil of the RF transformer to the op-amp. Frequency-demodulating the modulated electrical signal may include applying the modulated electrical signal to an input of a phase-locked-loop (PLL) integrated circuit having an output that provides the demodulated signal, with the the output signal obtained at the output of the PLL integrated circuit. Frequency-demodulating the modulated electrical signal may include providing the modulated electrical signal to a digital signal processor configured to perform frequency-demodulation. An analog-to-digital (A2D) conversion may be applied to the output signal to produce a digital output signal.

In general, in one aspect, a device measures displacement of a moving diaphragm in an electroacoustic transducer having a magnetic structure and a voice coil assembly comprising at least a voice coil aligned with the magnetic structure, one of the magnetic structure or the voice coil assembly coupled to the diaphragm. The device includes a first interface terminal configured to be electrically coupled to a first input of the voice coil, a second interface terminal configured to be electrically coupled to the magnetic structure, a first circuit configured to be coupled to at least the first input terminal and operable to provide a modulated electrical signal based on changes in capacitance between the voice coil assembly and the magnetic structure resulting from relative motion between the voice coil assembly and the magnetic structure. A second circuit demodulates the modulated electrical signal to produce an output signal having a voltage proportional to displacement of the diaphragm.

Implementations may include one or more of the following. The first circuit may include a frequency generator operable to apply a carrier signal having a frequency above an operating range of the electroacoustic transducer to the voice coil through the first interface terminal, the change in capacitance between the voice coil assembly and the magnetic structure, resulting from motion of the voice coil assembly and the magnetic structure, modulating the amplitude of the carrier signal as the carrier signal propagates to the magnetic structure through capacitive coupling between the voice coil and the magnetic structure. The second circuit may include an amplitude demodulator coupled to the second interface terminal and operable to amplitude-demodulate the modulated electrical signal received from the magnetic structure. The amplitude demodulator may include a high-pass filter having an input electrically coupled to the second interface terminal, an amplifier having an input coupled to an output of the high-pass filter, a rectifier having an input coupled to an output of the amplifier, and a low-pass filter having an input coupled to an output of the rectifier.

The first circuit may include an oscillator circuit electrically coupled to the first and second interface terminals, the change in capacitance between the voice coil assembly and magnetic structure, resulting from relative motion between the voice coil assembly and the magnetic structure, modulating the frequency of the oscillator circuit. The oscillator circuit may include an op-amp electrically coupled to the first and second terminals and configured for positive feedback operation, the output of the op-amp producing the modulated electrical signal. The first circuit may also include an RF transformer, the first and second interface terminals being coupled to respective first and second terminals of the primary coil of the RF transformer, and a terminal of the secondary coil of the RF transformer being coupled to the op-amp. The second circuit may include a frequency demodulator electrically coupled to an output of the first circuit and configured to frequency-demodulate the modulated electrical signal received from the first circuit. The frequency demodulator may include a phase-locked-loop (PLL) integrated circuit having an output that provides the demodulated signal.

The voice coil assembly may be coupled to the diaphragm, with the magnetic structure including a cup at least partially surrounding the voice coil, and the second interface terminal electrically coupled to the cup. The second interface terminal may include a lead attached to the cup. The second interface terminal may include an electrical contact pad in contact with the cup. The second interface terminal may include a plate positioned adjacent to the cup and insulated from the cup by a dielectric, the plate producing a signal from capacitive coupling between the cup and the plate. The dielectric may be air. An analog-to-digital converter may receive the output signal of the second circuit.

The magnetic structure may be coupled to the diaphragm, with the voice coil assembly including a voice coil and a core. The magnetic structure may include a magnet and an armature, the magnet including a conductive material, where the modulated electrical signal is modulated by changes in capacitance between the voice coil assembly and the magnet. The magnetic structure may include a magnet and an armature, the armature including a conductive material, where the modulated electrical signal is modulated by changes in capacitance between the voice coil assembly and the armature.

In general, in one aspect, a device includes an electroacoustic transducer, which includes a moving diaphragm, a magnetic structure, and a voice coil assembly which includes at least a voice coil aligned with the magnetic structure and has at least a first input. One of the magnetic structure or the voice coil assembly is coupled to the diaphragm. The device also includes a first interface terminal electrically coupled to the first input of the voice coil, a second interface terminal configured to be electrically coupled to the magnetic structure, and a first circuit coupled to the first input terminal and operable to generate a modulated electrical signal based on changes in capacitance between the voice coil and the magnetic structure resulting from relative motion between the voice coil and the magnetic structure. Implementations may include one or more of the following. A second circuit may demodulate the modulated electrical signal to produce an output signal having a voltage proportional to displacement of the diaphragm. The second circuit may be coupled to the second interface terminal. The first circuit may be coupled to the second interface terminal and the second circuit may be coupled to an output of the first circuit. An output terminal may provide the modulated electrical signal Advantages include sensing the displacement of the moving structure without contacting it or modifying it in ways that affects its behavior, such as adding substantial moving mass, so that the mechanical dynamic performance of the transducer is not substantially changed by the measurement. Measuring the displacement from the transducer directly may allow measurement over a broader frequency range and with lower noise than a discrete sensor.

Other features and advantages will be apparent from the description and the claims.

DESCRIPTION

Figure 1A:
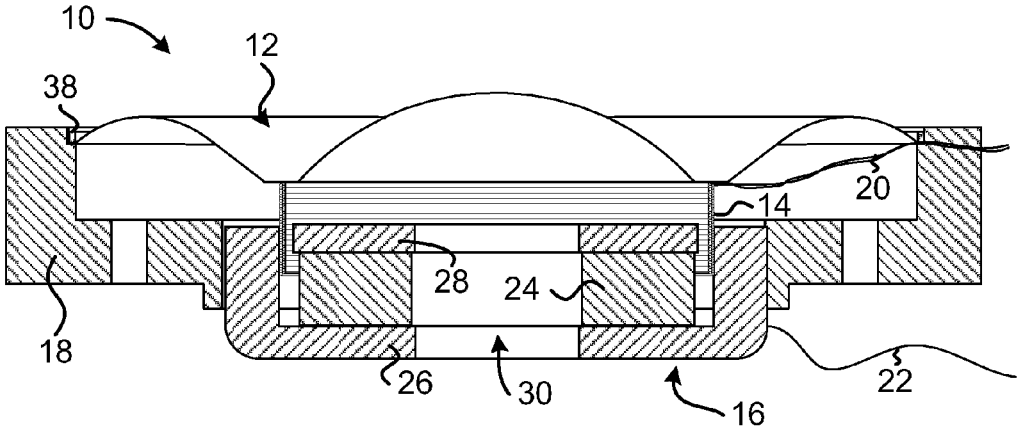
FIG. 1A shows a cross-sectional plan view of an electroacoustic transducer.
Figure 1B:
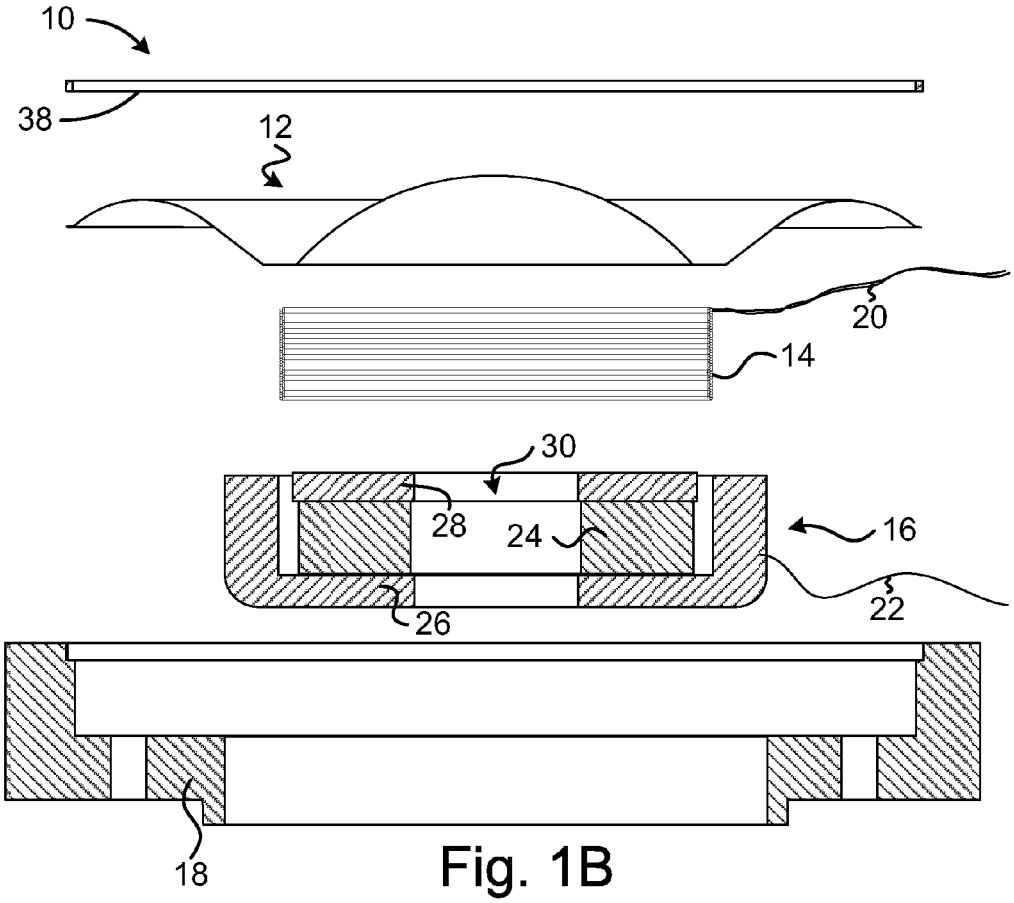
FIG. 1B shows an exploded cross-sectional plan view of an electroacoustic transducer
Figure 2:
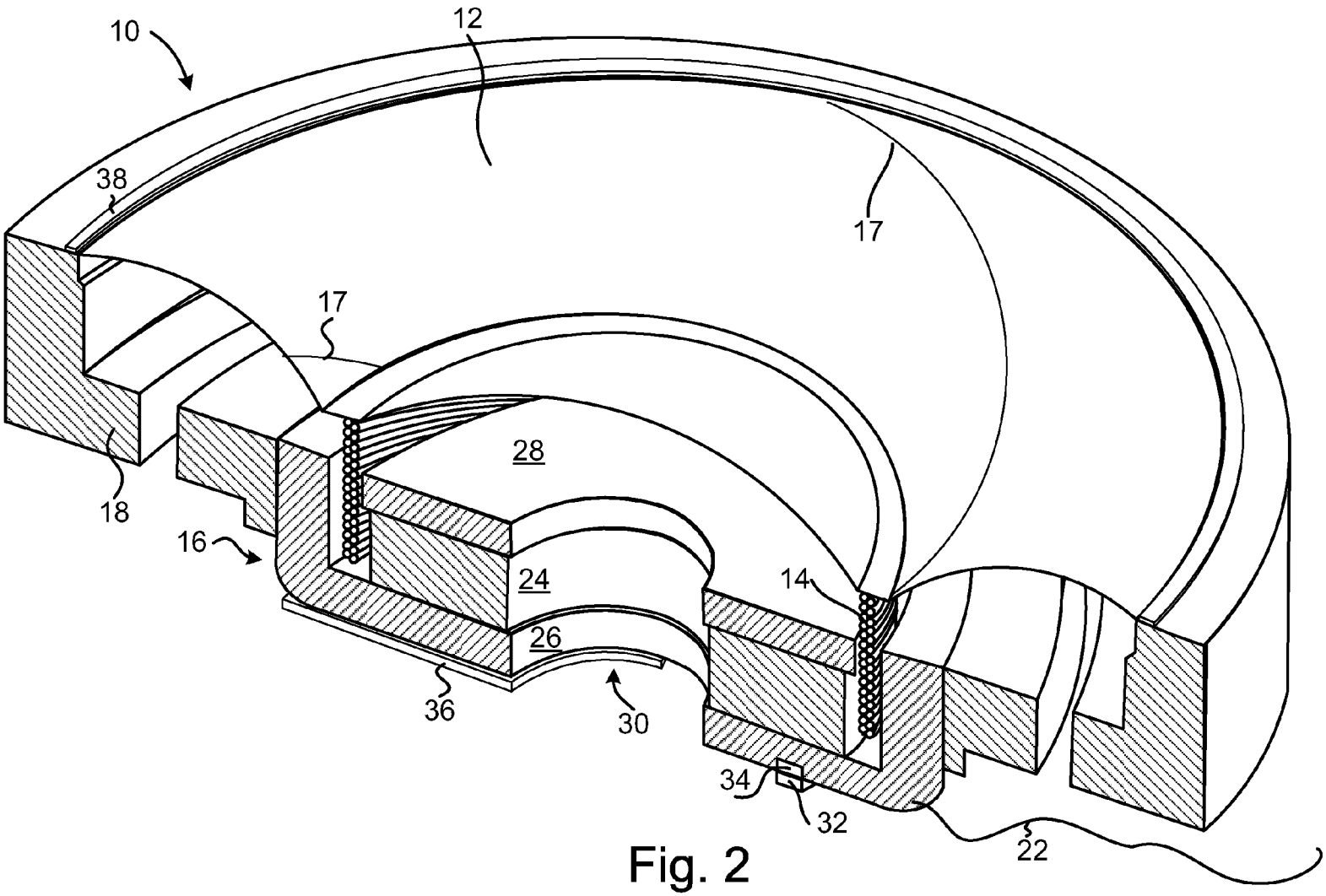
FIG. 2 shows a cross-sectional isometric views of an electroacoustic transducer.

An electromechanical transducer is coupled to a circuit that measures the displacement of the transducer. Such a circuit can be advantageous in a feedback control system where perturbations to the transducer are corrected by the control loop. For reference, an electroacoustic transducer 10 is shown in FIGS. 1A, 1B, and 2. Transducer 10 includes a diaphragm 12, a voice coil 14, which may be self-supporting, or may be wound around a coil-former or bobbin (not shown), a magnetic assembly 16, and a basket 18. The voice coil 14 is connected to external circuitry (not shown) through signal leads 20, which may exit the transducer through various paths depending on the specific design of the transducer and provide two inputs to the voice coil. In the example of FIGS. 1A and 1B, the leads are loosely routed from the voice coil to the edge of the transducer. In the example of FIG. 2, the leads are attached to the diaphragm in a spiral pattern.

When electrical current is applied to the voice coil 14, it interacts with the magnetic field of the magnetic assembly 16 to produce the forces that move the voice coil 14 and diaphragm 12 relative to the magnetic assembly 16 and basket 18 to produce acoustic radiation. In some examples, the voice coil 14 and at least part of the magnetic assembly 16 are reversed, such that the magnetic assembly moves the diaphragm and the voice coil remains stationary relative to the basket. In the particular type of transducer shown, the diaphragm includes a dome and a surround or suspension. In other types of transducers, a cone may be used to provide additional radiating surface area.

Referring again to FIGS. 1A-1B and 2, the magnetic assembly 16 includes a ring magnet 24, a cup 26, and a pole piece 28, also called a top plate or coin. Other motor structure geometries may be used, depending on the particular application of the transducer. A hole 30 through the magnetic assembly allows air compressed on the back side of the diaphragm to escape out the back of the transducer. In some transducers, a limiter (not shown) seated atop the top plate physically limits the range of motion of the diaphragm. A ring 38 anchors the outer periphery of the diaphragm 12 to the basket 18. The particular physical structures shown here are for illustration only, as the invention described below may be applicable to any type of electroacoustic transducer, however constructed. The physical components that support the active parts of the transducer but do not themselves contribute to the acoustic function aside from being present in the environment, such as the basket 18, are referred to generically as the "housing."

To facilitate the measurement of the displacement of the voice coil 14 relative to the stationary parts of the structure, an electrical connection is made to the cup 26. FIG. 2 shows three alternative methods of making this connection. In one example, a lead 22 is directly connected to the cup 26. The lead 22 may be soldered, glued, clipped, or otherwise electrically and mechanically coupled to the cup. In another example, a contact pad 32 contacts the cup, either directly or through a complementary contact pad 34. The contact pad 32 is in turn connected to external circuitry through a lead (not shown) or directly to a circuit board (not shown), if one is present, or other suitable connection techniques. In a third example, a plate 36 is located adjacent to the cup 26, separated from the cup by a small air gap or a layer of dielectric material. Capacitive coupling between the cup 26 and plate 36 allows extraction of a signal at the cup without galvanic connection to the cup, allowing a contactless measurement of the desired signal. The plate 36 may cover a portion of the cup 26, as shown, or may cover the entire surface area of the cup. Like the contact pad, the plate may be coupled to external circuitry through any suitable connection technique. Any of these or similar connections may be generically referred to as an interface terminal, as is the connection 20 to the voice coil.

Figures 3A, 3B, 3C:
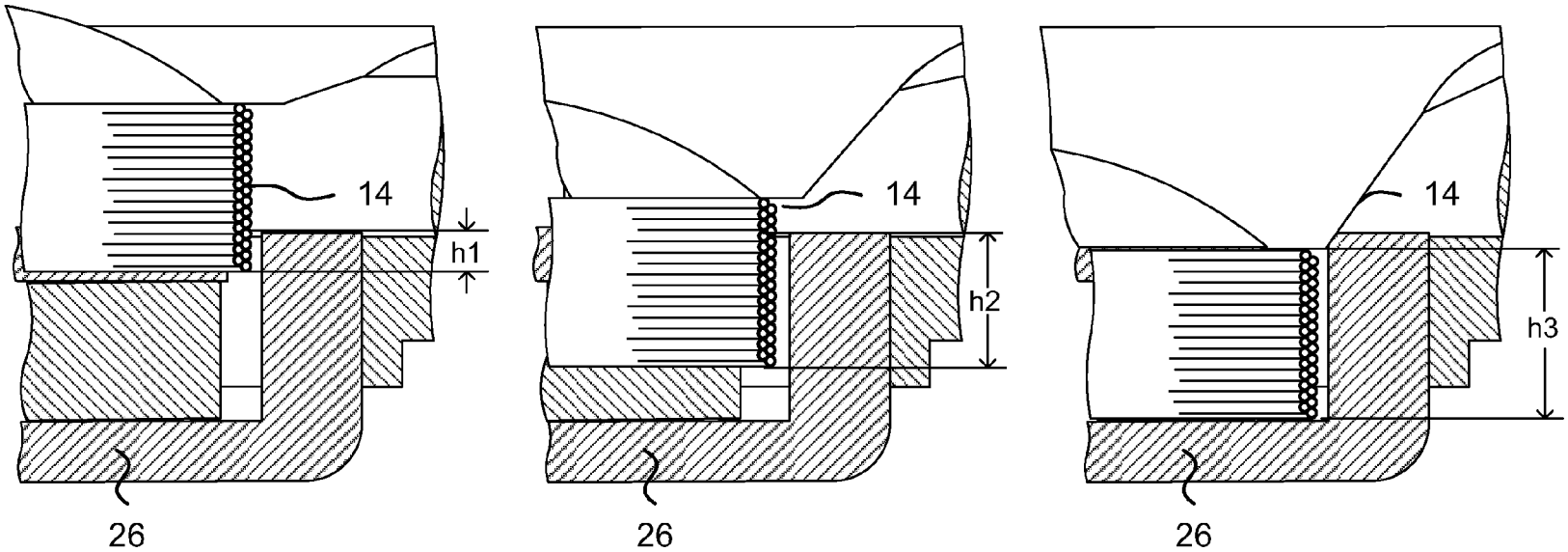
FIGS. 3A through 3C show close-up cross-sectional views of a portion of an electroacoustic transducer.

A capacitance exists between the voice coil 14 and the side walls of the cup 26. As shown in FIGS. 3A-3C, as the voice coil 14 moves in and out of the cup 26, the length of voice coil, marked as h1, h2, and h3, where the voice coil and the wall of the cup are aligned, and therefore the amount of surface area and resulting capacitance between them, varies. In FIG. 3A, the aligned surface area with height h1, and therefore the capacitance, are minimal, while in FIG. 3C, they are at their maximum. Whether the voice coil is ever fully aligned with the cup, as shown in FIG. 3C, will depend on the construction or use of a particular transducer. The measurement circuit determines displacement of the diaphragm based on this variation in the coil-to-cup capacitance, sensed using one of the connection methods discussed above. In some examples, the capacitance between the voice coil and the pole piece 28 is part of the measurement.

Figure 4A:
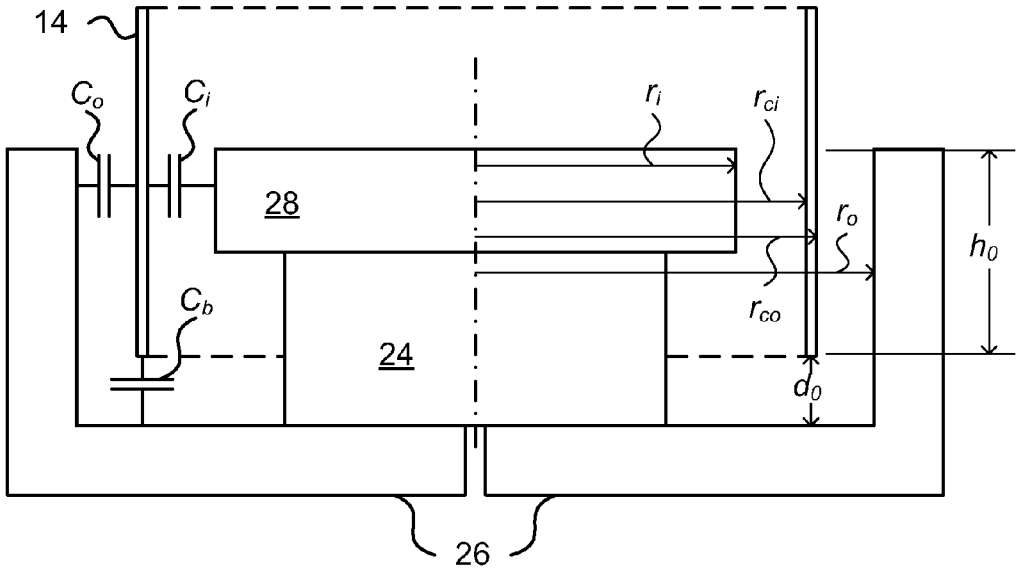
FIG. 4A shows a schematic sectional view of a portion of an electroacoustic transducer.

FIG. 4A shows a schematic view of the various capacitances present between the voice coil and surrounding parts. The voice coil 14 is shown as a cylindrical shell, surrounding the pole piece 28 and magnet 24 and surrounded by the sides of the cup 26. There are several capacitances shown in FIG. 4A: capacitance $C_o$ between the outside surface of the voice coil and the inside surface of the side of the cup 26, capacitance $C_b$ between the bottom edge of the voice coil and the top surface of the base of the cup, and capacitance $C_i$ between the inside surface of the voice coil and the surface of the outer edge of the pole piece 28. The capacitances are shown at one side of the cross-sectional view, but each capacitance exists around some portion of the circumference of the voice coil. In some examples, the cup or pole piece is split into separate conductive portions, in which case separate capacitances may exist between each part and the voice coil. In FIG. 4A, the cup is shown as two parts, so capacitances $C_o$ and $C_b$ are each two separate capacitances. The pole piece is shown as one part, so capacitance $C_i$ is a single capacitance. If the split parts are electrically connected before being coupled to external circuitry, then the capacitances can be combined and treated as a single capacitance in modeling the system.

Various dimensions are also shown in FIG. 4A, at the other side of the figure from the capacitances. The length of voice coil overlapping the cup sides when the voice coil is at rest is $h_0$. The radius of the outer surface of the voice coil is, $r_{co}$, while the radius of the inner surface is $r_{ci}$. The radius of the inner surface of the side of the cup is $r_o$, and the radius of the surface of the outer edge of the pole piece is $r_i$. The space between the bottom edge of the voice coil and the top surface of the base of the cup when the voice coil is at rest is $d_0$. The transducer shown in the figures is idealized—in real components, the various dimensions may not be as uniform as shown. For example, in some transducers, the cup is closer to the coil in the vicinity of the pole piece than elsewhere to concentrate the magnetic field, so $r_o$ varies along the height of the cup wall.

Figure 4B:
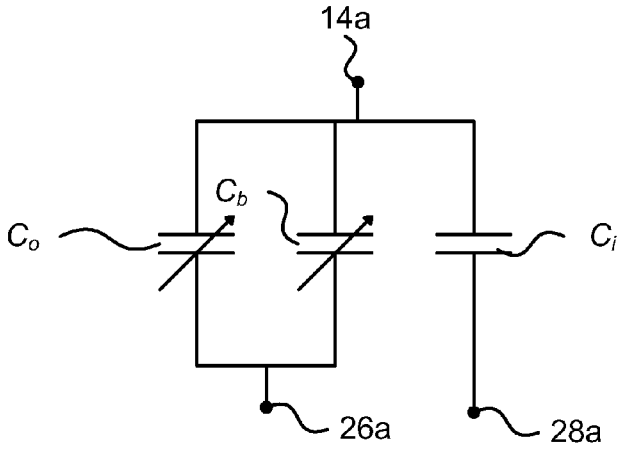
FIGS. 4B, 6, and 7 show schematic circuit diagrams.

FIG. 4B shows the same capacitances from FIG. 4A in the form of a circuit diagram. The capacitances $C_o$ and $C_b$ are shown as variable capacitors. As the cup moves up and down, the surface area of capacitance $C_o$ varies, as does the gap in the capacitance $C_b$, thus these capacitances are variable. In contrast, as long as the voice coil 14 does not move so far that its lower edge is above the lower surface of the pole piece, the same surface area is always present in the capacitance $C_i$ (neglecting any edge effects at the end of the voice coil's travel), so it is shown as fixed capacitor. All of the capacitors are coupled at a node 14*a* corresponding to the voice coil, while capacitors $C_o$ and $C_b$ are coupled at a node 26*a* corresponding to the cup, and capacitor $C_i$ shown coupled to a node 28*a* corresponding to the pole piece. If the cup were split into more than one piece, then there would be a corresponding number of pairs of variable capacitors and nodes. The total capacitance between the voice coil and the cup will depend on how the metal parts are connected to the external circuitry.

If the pole piece is electrically connected to the cup, node 28*a* will be coupled to the node 26*a*, and the capacitance between the voice coil and the pole piece will affect the capacitance measured between the voice coil and the cup. If the pole piece is not electrically coupled to the cup, the node 28*a* will be left floating and the capacitance between the voice coil and the cup can be ignored. If the cup is divided into separate parts but they are electrically coupled, then the corresponding nodes will be coupled to each other, and the effective capacitances will be combined. In total, the measured capacitance between the voice coil and the cup (when nodes 26*a* and 28*a* are coupled) will be:

$$C(h)=C_o(h)+C_b(h)+C_i \tag{1}$$

where h is the displacement of the voice coil downward from its resting position. The two variable capacitances are found from:

$$C_o(h) = \varepsilon\varepsilon_0 \frac{2\pi\left(\frac{r_{co}+r_o}{2}\right)(h_o+h)}{r_o - r_{co}} \tag{2}$$

$$C_b(h) = \varepsilon\varepsilon_0 \frac{(\pi r_{co}^2 - \pi r_{ci}^2)}{(d_o - h)}. \tag{3}$$

The various measurements are defined in FIG. 4A. For use in air, relative permittivity or dielectric constant c is around 1.00054 (unitless). In equation 2, the variable area of overlap between the voice coil and the cup sides is found by multiplying the circumference of a mid-point of the gap by the length of the overlap. As the voice coil moves down, h increases, as does the area and the capacitance. As the voice coil moves up, h decreases, and so does the area and the capacitance. As everything in equation 2 is fixed except h, $C_o$(h) varies linearly with h. In equation 3, the variable gap between the base of the cup and the bottom edge of the voice coil is found by subtracting the displacement d from the length of that gap at rest, $g_0$. As the voice coil moves down, d increases, the gap decreases, and capacitance increases. As the voice coil moves up, h decreases, the gap increases, and the capacitance decreases. $C_b(h)$ is not linear with h, but is significantly smaller than $C_o$, and can be neglected. For example, with the measurements of a 40 mm transducer and assuming uniform gap widths between parts, $C_o(h)$ varies between about 5 and 8 pF (where the voice coil has +/−0.75 mm of travel), while $C_b(h)$ has a value between about 0.04 and 0.08 pF. In the same example, $C_i$ has a fixed value of about 2 pF, but it can also be neglected if the pole piece is not electrically coupled to the cup. If the pole piece is attached, $C_i$ will add a fixed offset to the total capacitance.

Figure 5:
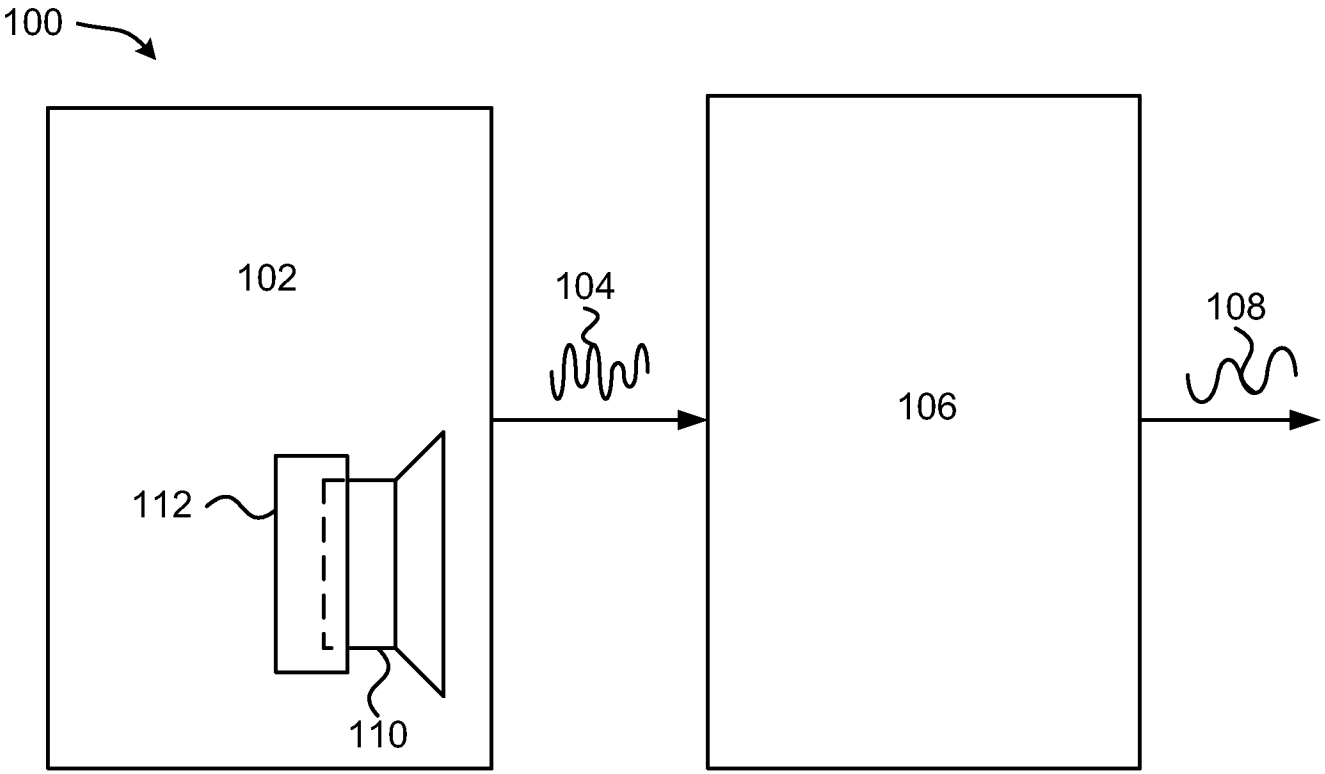
FIG. 5 shows a block diagram of a modulating and demodulating circuit.

In a generalized example, shown in FIG. 5, a measurement circuit 100 includes two major portions. A first circuit block 102 uses the transducer to modulate a signal 104 based on the motion of the voice coil relative to the cup. A second circuit block 106 demodulates the signal from the first circuit block and produces an output signal 108 proportional to the displacement of the diaphragm.

In the first circuit block 102, as the voice coil 110 moves the diaphragm, and the capacitance between the voice coil and the cup 112 changes, this capacitance is used as the source for modulation to produce the modulated signal 104. The modulation may be amplitude modulation (AM), frequency modulation (FM), or any other type of modulation that communicates the value of the capacitance via the modulated signal. The second circuit block 106 uses the corresponding type of demodulator (i.e., an AM or FM demodulator) to demodulate the modulated signal and extract the communicated value. Depending on the actual method by which the first circuit block modulates the signal, the extracted signal output by the second circuit block may directly represent the capacitance, or may represent the capacitance in some other way that allows the displacement of the voice coil to be determined through subsequent processing or analysis. Two types of modulation and demodulation based on the capacitance between the voice coil and the cup are described below.

Figure 6:
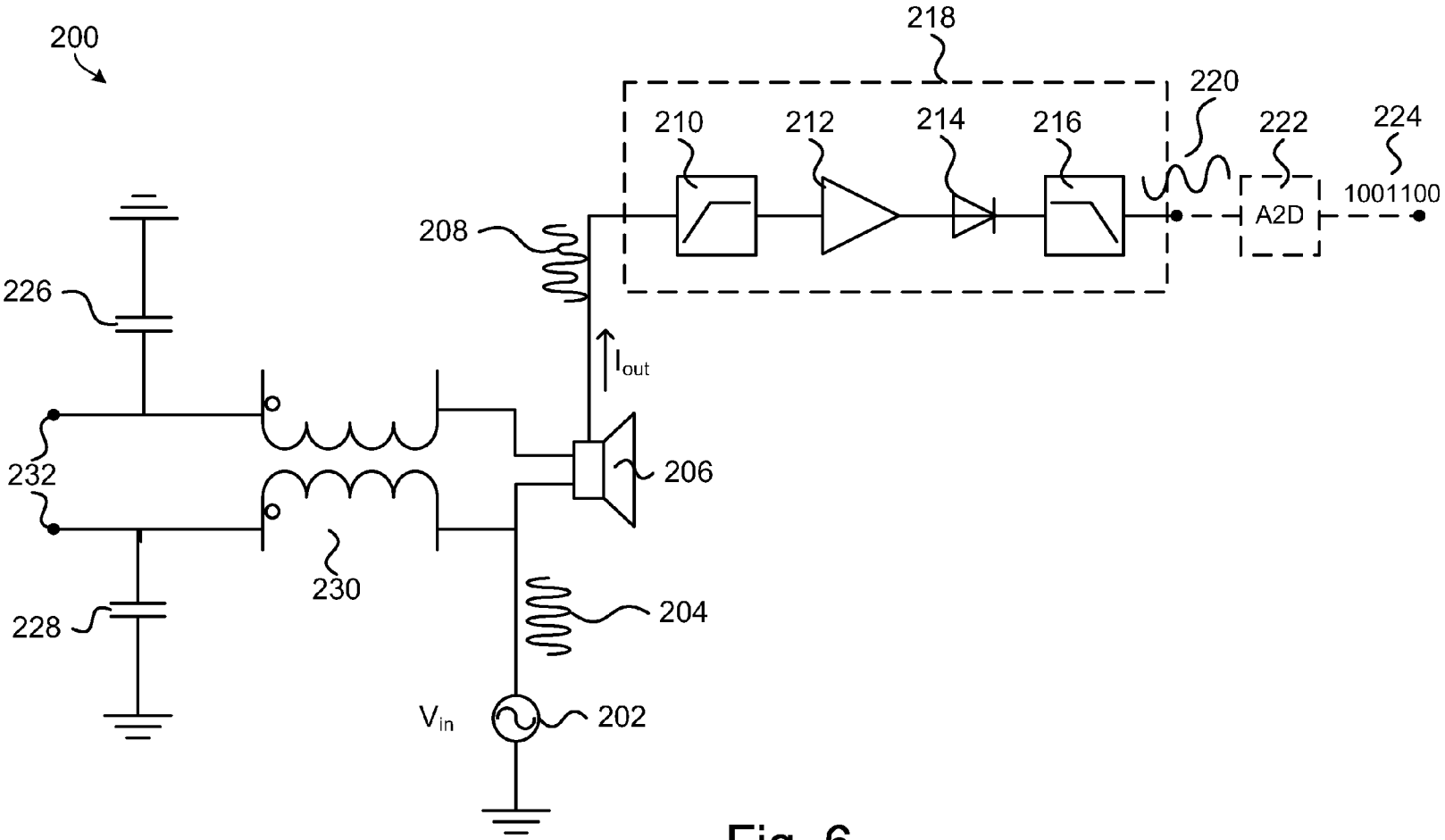

In one example, shown in FIG. 6, a circuit 200 includes a signal source 202 producing a high-frequency carrier signal 204 that is input to the voice coil of the transducer 206 through an interface terminal connected to one of its signal leads. The signal source 202 may be any suitable frequency generator for providing the carrier signal to the voice coil input. This carrier signal 204 is preferably above the range of human hearing, or at least above the range that can audibly be reproduced by the transducer 206, i.e., above the transducer's operating range. The carrier signal inserted into the voice coil is transferred to the cup through capacitive coupling and is detected using an interface terminal such as the lead 22, contact pads 32 and 34, or capacitive plate 36 shown in the example of FIG. 2. In some examples, this connection is the only modification (which, in the case of the plate 36, may be no modification) needed to a conventional transducer to allow measurement of the transducer's displacement based on the coil-to-cup capacitance. As the motion of the voice coil changes the capacitance between the coil and the cup, it directly modulates the amplitude of the carrier signal, i.e., $$I_{out} = C(h)\frac{dV_{in}}{dt},$$

where $V_{in}$ is the voltage into the voice coil, and $I_{out}$ is the current in the lead out from the cup, as shown in FIG. 6. For a sinusoid input voltage, the output current will simply be the same sinusoid scaled by C(h) and phase shifted by −90 degrees.

The amplitude-modulated signal 208 detected at the cup is routed through a high-pass filter 210, a gain element 212, a rectifier 214, and a low-pass filter 216. These elements serve as a demodulator 218 to demodulate the signal, such that the voltage of the signal 220 output from the low-pass filter 216 is directly proportional to the coil-to-cup capacitance and therefore varies essentially linearly with the voice coil's displacement relative to the stationary parts. In some examples, the analog output signal 220 is provided to an analog-to-digital converter 222 to provide a digital representation 224 of the output signal 220.

In the example of FIG. 6, the high-pass filter 210 separates the modulated carrier signal from any audio-band signal leaking into the cup. The gain element 212 then adjusts the gain of the signal to an appropriate value for the subsequent stages, and the rectifier 214 and low-pass filter 216 demodulate the signal, extracting the output signal 220 from the carrier signal. The corner frequencies, filter order, and gain of the components will depend on the particular values being measured and signals being used in a given application. Any suitable isolating and demodulating circuit can be used in place of the circuit 218 shown, such as a suitably-programmed digital signal processor.

Any appropriate source of audio signals for reproduction by the transducer 24 may be provided on the input terminals 232. In addition to the circuit elements directly involved in generating the signal representative of coil position, a pair of bypass capacitors 226, 228 and a common mode choke 230 serve as a low-pass filter to keep the high-frequency carrier signal 28 from propagating back to the audio signal source. Other filtering techniques may be appropriate, depending on the source of audio signals connected to the input terminals 232.

Figure 7:
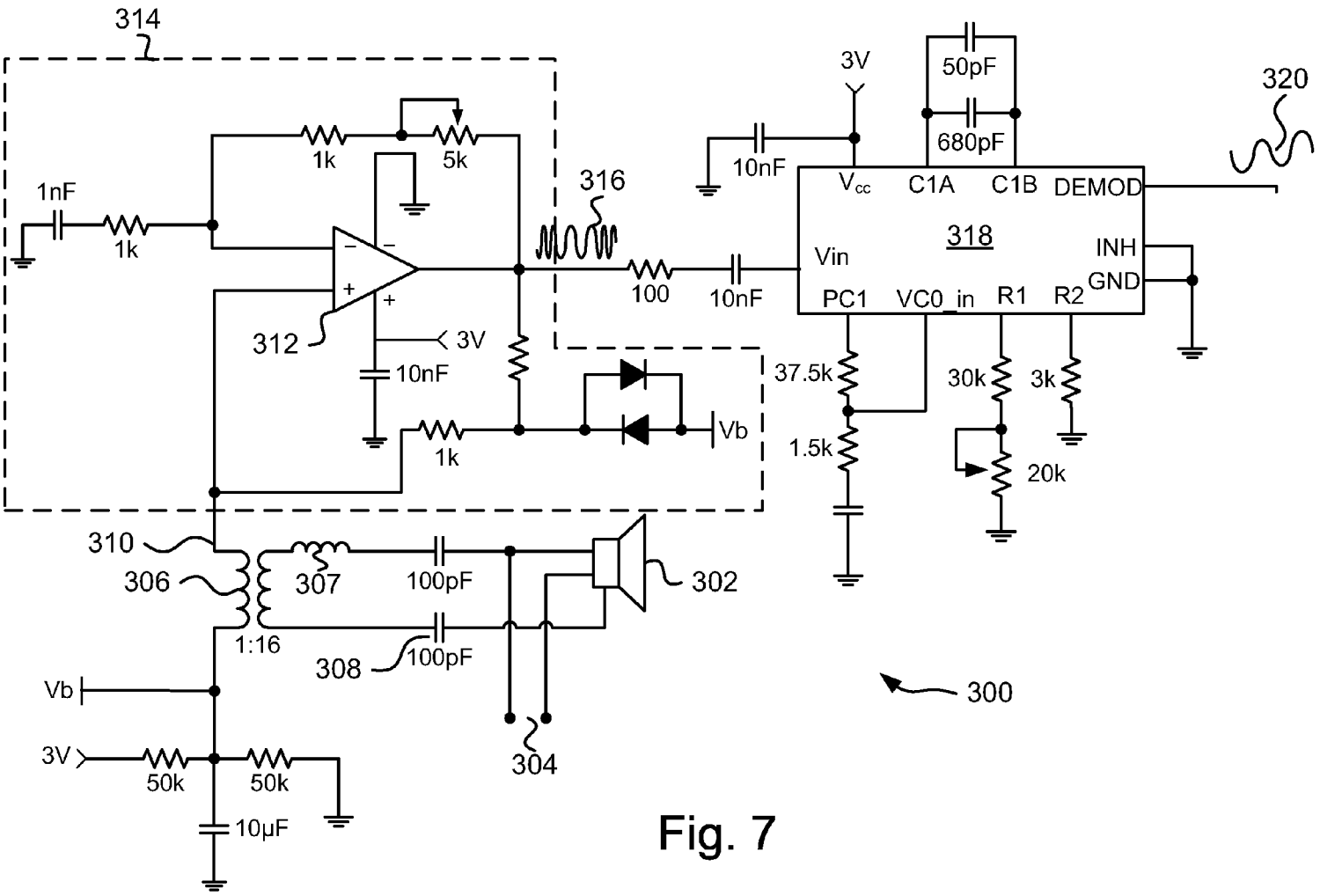

In another example, shown in FIG. 7, FM modulation is used. In a circuit 300, rather than passing a carrier signal through the transducer 302, the capacitance between the voice coil and the cup is used as a variable capacitor to control the frequency of an oscillator circuit 314. As noted above, the typical capacitance of a small transducer, such as a 40 mm headphone driver, is on the order of 10 pF, varying ±1 pf with a ±1 mm normal coil displacement. Smaller and larger transducers will have similarly smaller and larger capacitances and capacitance-to-displacement relationships. In circuit 300, the same connections to the transducer 302 are used as in FIG. 6—a first interface terminal connected one lead to an input of the voice coil, and a second interface terminal making a connection to the cup. Using these connections, the transducer 302 is connected across the primary coil of an RF transformer 306 via a pair of buffer capacitors 308.

The transformer 306 steps up the capacitance value of the transducer by $N^2$, increasing the sensitivity of the circuit to the changes in the capacitance between the voice coil and the cup. In the example of FIG. 7, the transformer 306 has a turn ratio N of 16:1, increasing the sensitivity by 256×. The turns ratio may be selected to give whatever sensitivity multiplier is required to obtain useful signals from the capacitance to be measured. The output 310 of the transformer's secondary coil is connected to the non-inverting input of an op-amp 312, which is configured in positive feedback to form an LC oscillator circuit block 314 that oscillates at a variable frequency controlled by the coil-to-cup capacitance, thus frequency-modulating the variations in capacitance around a base frequency determined by the capacitance when the voice coil is at rest. Specifically, the oscillator frequency will vary as:

$$F_o = \frac{1}{\sqrt{2\pi LN^2 C(h)}} \quad (4)$$

where L is the effective inductance 307 of the RF transformer 306 and C(h) is the variable coil-to-cup capacitance described above. For a 40 mm transducer, the resting frequency was measured at 1 MHz, and the frequency deviation due to coil displacement was ~±60 kHz. One suitable transformer in this example is a Coilcraft model PWB-16-AL transformer, while the op-amp may be an LM8621 by National Semiconductor, but any suitable components may be used. In some examples, the sensitivity of the circuit is such that the transformer is not needed and the transducer may be directly coupled to the op-amp. In some examples, such a direct connection would include DC blocking capacitors between the transducer and the op-amp. Other suitable frequency-modulation circuits may also be used in place of the LC oscillator circuit 314.

The frequency-modulated (FM) signal 316 output from the oscillator circuit 314 can then be demodulated to find the coil displacement. In the example of circuit 300, the frequency demodulation is provided by a CMOS PLL integrated circuit 318, such as a model 74HC4046 from NXP Semiconductors. The PLL 318 extracts the modulation frequency from the signal 316 output by the oscillator circuit 314 and provides the value of that modulation frequency in an output signal 320. Any other suitable FM demodulation circuitry may be used, including a digital signal processor or a suitably programmed microprocessor, to name some examples.

If necessary, additional signal processing or other operations, such as a look up table, may be used to linearize the output. For such small changes in capacitance around a relatively larger base capacitance, however, the change in output value is approximately linear, and can be used as a direct approximation of displacement.

The output 320 is an analog waveform, its voltage tracking the coil position as noted, but an additional analog-to-digital converter (not shown) could be used to provide a digital output as shown in FIG. 6. The various other circuit elements, voltage inputs, and grounds used to control the circuit are not labeled, but the values used in the particular embodiment shown are included.

Two methods of measuring the change in capacitance in a transducer resulting from its motion have been described. Other methods may also be used, such as applying an impedance bridge or applying a DC bias to the basket and measuring current flow in and out of the basket as capacitance changes, with, for example, a FET-input preamp.

Electromechanical transducers include electroacoustic transducers (also referred to as loudspeakers and microphones), linear or rotary electric motors, and electromechanical sensors. This disclosure is concerned generally with transducers that cause or measure small and generally oscillating movements, where a moving portion of the transducer moves back and forth around a stationary portion. For example, in a loudspeaker, the acoustically-radiating surface, referred to as the diaphragm, and some portion of the motor structure move back and forth, while another portion of the motor structure remains stationary. In some examples, such as that shown in FIGS. 1 through 3, the moving portion of the motor is a voice coil positioned around a magnetic structure. In other examples, the voice coil is inside a hollow magnetic structure.

Figure 8:
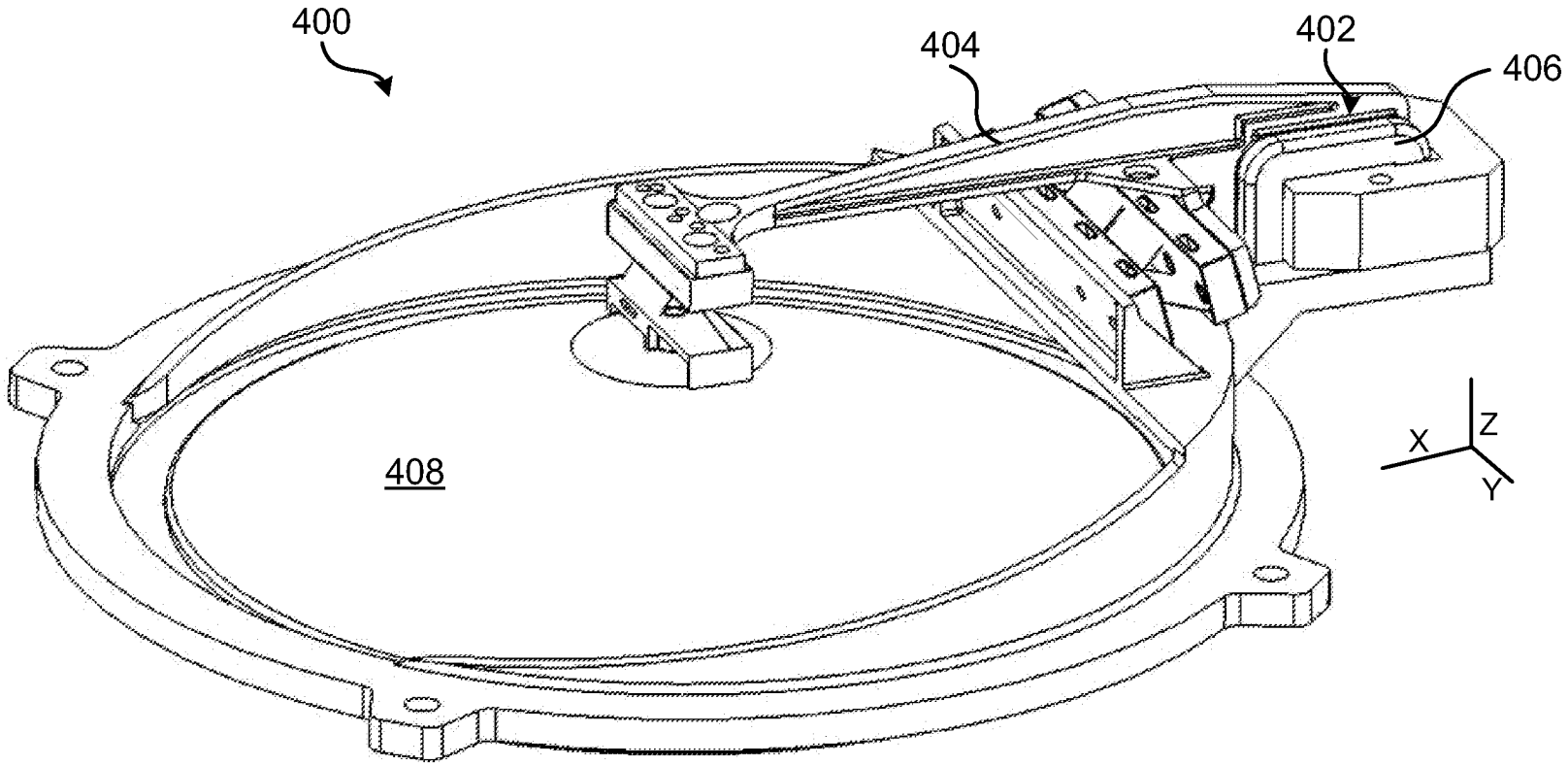
FIG. 8 shows a three-quarters view of an electroacoustic transducer.

In still other examples, the coil is stationary and it is the magnet that moves the diaphragm, or the diaphragm is magnetically responsive and requires no additional moving components. In a moving-magnet transducer, the capacitance between the stationary coil and core and the moving magnet may be used in the same manner described above, provided that the magnet is conductive is or mounted in a carrier made of conductive material. An example of such a transducer is shown in FIG. 8 and described in U.S. patent application Ser. No. 12/751,352, incorporated here by reference. In the transducer 400 of FIG. 8, a magnet 402 is held in an end of a lever arm 404 that suspends the magnet in between a coil 406 (only one side visible). The other end of the lever arm moves the diaphragm 408. Either the magnet or the end of the lever arm holding the magnet may be made of conductive material and used in the circuits described above, with the stationary coil still connected to one terminal of the circuits. The other terminal may be connected to the lever arm using a flexible lead, or it may be connected to a stationary part of the transducer, if a conductive path exists from that part to the lever arm. In non-acoustic applications, an electromagnetic linear motor includes a moving armature and a stationary stator. Either one of the armature and stator may include the magnets and the other the coils or some other mechanism for converting electric energy into motion of the armature.

Other implementations are within the scope of the following claims and other claims to which the applicant may be entitled.

What is claimed is:

1. A method of measuring displacement of a moving diaphragm in an electroacoustic transducer having a magnetic structure and a voice coil assembly comprising at least a voice coil aligned with the magnetic structure, one of the magnetic structure or the voice coil assembly coupled to the diaphragm, the method comprising:

producing a modulated electrical signal by modulating an electrical signal based on changes in capacitance between the voice coil and the magnetic structure resulting from motion of the voice coil relative to the magnetic structure; and demodulating the modulated electrical signal to produce an output signal having a value proportional to the displacement, wherein:

producing a modulated electrical signal comprises applying a carrier signal having a frequency above an operating range of the electroacoustic transducer to a first input terminal of the voice coil such that changes in capacitance between the voice coil assembly and the magnetic structure of the transducer caused by motion of the voice coil assembly relative to the magnetic structure modulates the amplitude of the carrier signal.

2. The method of claim 1 wherein demodulating the modulated electrical signal comprises amplitude-demodulating the modulated electrical signal to produce the output signal.

3. The method of claim 2 wherein amplitude-demodulating the modulated electrical signal comprises:

applying a high-pass filter to the modulated electrical signal to produce a high-pass filtered signal;

applying a gain to the high-pass filtered signal to produce a level-adjusted signal;

rectifying the level-adjusted signal to produce a rectified signal; and applying a low-pass filter to the rectified signal to produce the output signal.

4. The method of claim 2 wherein amplitude-demodulating the modulated electrical signal comprises providing the modulated electrical signal to a digital signal processor configured to perform amplitude demodulation.

5. The method of claim 1 further comprising preventing the carrier signal from propagating to an audio signal input path of the transducer.

6. The method of claim 5 wherein preventing the carrier signal from propagating to the audio signal input path comprises:

coupling the first input terminal of the voice coil to a first terminal of a first coil of an RF choke transformer, coupling a second input terminal of the voice coil to a first terminal of a second coil of the RF choke transformer, coupling a second terminal of the first coil to ground through a first capacitor and to a first signal input, and coupling a second terminal of the second coil to ground through a second capacitor and to a second signal input.

7. The method of claim 1 further comprising applying an analog-to-digital (A2D) conversion to the output signal to produce a digital output signal.

8. An apparatus for measuring displacement of a moving diaphragm in an electroacoustic transducer having a magnetic structure and a voice coil assembly comprising at least a voice coil aligned with the magnetic structure, one of the magnetic structure or the voice coil assembly coupled to the diaphragm, the apparatus comprising:

a first interface terminal configured to be electrically coupled to a first input of the voice coil;

a second interface terminal configured to be electrically coupled to the magnetic structure;

a first circuit configured to be coupled to at least the first input terminal and operable to provide a modulated electrical signal based on changes in capacitance between the voice coil assembly and the magnetic structure resulting from relative motion between the voice coil assembly and the magnetic structure, wherein the first circuit comprises:

a frequency generator operable to apply a carrier signal having a frequency above an operating range of the electroacoustic transducer to the voice coil through the first interface terminal;

the change in capacitance between the voice coil assembly and the magnetic structure, resulting from relative motion between the voice coil assembly and the magnetic structure, modulating the amplitude of the carrier signal as the carrier signal propagates to the magnetic structure through capacitive coupling between the voice coil and the magnetic structure.

9. The apparatus of claim 8 further comprising a second circuit operable to demodulate the modulated electrical signal to produce an output signal having a voltage proportional to displacement of the diaphragm.

10. The apparatus of claim 9 wherein the second circuit comprises an amplitude demodulator coupled to the second interface terminal and operable to amplitude-demodulate the modulated electrical signal received from the magnetic structure.

11. The apparatus of claim 10 wherein the amplitude demodulator comprises:

a high-pass filter having an input electrically coupled to the second interface terminal;

an amplifier having an input coupled to an output of the high-pass filter;

a rectifier having an input coupled to an output of the amplifier; and a low-pass filter having an input coupled to an output of the rectifier.

12. The apparatus of claim 8 wherein:

the voice coil assembly is coupled to the diaphragm, the magnetic structure comprises a cup at least partially surrounding the voice coil, and the second interface terminal is configured to be electrically coupled to the cup.

13. The apparatus of claim 12 wherein the second interface terminal comprises a lead attached to the cup.

14. The apparatus of claim 12 wherein the second interface terminal comprises an electrical contact pad in contact with the cup.

15. The apparatus of claim 12 wherein the second interface terminal comprises a plate positioned adjacent to the cup and insulated from the cup by a dielectric, the plate producing a signal from capacitive coupling between the cup and the plate.

16. The apparatus of claim 15 wherein the dielectric is air.

17. The apparatus of claim 12 further comprising an analog-to-digital converter receiving the output signal of the second circuit.

18. The apparatus of claim 8 wherein the magnetic structure is coupled to the diaphragm, and the voice coil assembly comprises a voice coil and a core.

19. The apparatus of claim 18 wherein the magnetic structure comprises a magnet and an armature, the magnet comprises a conductive material, and the modulated electrical signal is modulated by changes in capacitance between the voice coil assembly and the magnet.

20. The apparatus of claim 18 wherein the magnetic structure comprises a magnet and an armature, the armature comprises a conductive material, and the modulated electrical signal is modulated by changes in capacitance between the voice coil assembly and the armature.

21. An apparatus comprising:

an electroacoustic transducer comprising:

a moving diaphragm, a magnetic structure, and a voice coil assembly comprising at least a voice coil aligned with the magnetic structure and having at least a first input, wherein one of the magnetic structure or the voice coil assembly is coupled to the diaphragm;

a first interface terminal electrically coupled to the first input of the voice coil;

a second interface terminal configured to be electrically coupled to the magnetic structure; and a first circuit coupled to the first input terminal and operable to generate a modulated electrical signal based on changes in capacitance between the voice coil and the magnetic structure resulting from relative motion between the voice coil and the magnetic structure, wherein the first circuit comprises:

a frequency generator operable to apply a carrier signal having a frequency above an operating range of the electroacoustic transducer to the voice coil through the first interface terminal;

the change in capacitance between the voice coil assembly and the magnetic structure, resulting from relative motion between the voice coil assembly and the magnetic structure, modulating the amplitude of the carrier signal as the carrier signal propagates to the magnetic structure through capacitive coupling between the voice coil and the magnetic structure.

22. The apparatus of claim 21 further comprising:

a second circuit operable to demodulate the modulated electrical signal to produce an output signal having a voltage proportional to displacement of the diaphragm.

23. The apparatus of claim 21 wherein the second circuit is coupled to the second interface terminal.

24. The apparatus of claim 22 wherein the first circuit is coupled to the second interface terminal and the second circuit is coupled to an output of the first circuit.

25. The apparatus of claim 21 further comprising:

an output terminal providing the modulated electrical signal.

26. The apparatus of claim 8 further comprising:

a first terminal of a first coil of an RF choke transformer coupled to the first input terminal of the voice coil, a first terminal of a second coil of the RF choke transformer coupled to a second input terminal of the voice coil, a first capacitor and a first signal input coupled to a second terminal of the first coil, the first capacitor coupling the second terminal of the first coil to ground, and a second capacitor and a second signal input coupled to a second terminal of the second coil, the second capacitor coupling the second terminal of the first coil to ground.

* * * * *